US005134440A

United States Patent [19]

Nishimori

[11] Patent Number: 5,134,440

[45] Date of Patent: Jul. 28, 1992

[54] DEVICE AND METHOD FOR FORMING AN IMAGE OF A DOCUMENT IN MORE THAN ONE COLOR INCLUDING AUTOMATIC OR USER SELECTION OF COLORS TO BE USED IN SPECIFIED AREAS OF THE DOCUMENT

[75] Inventor: Kadotaro Nishimori, Osaka, Japan

[73] Assignee: Minolta Camera Kabushiki Kaisha, Osaka, Japan

[21] Appl. No.: 391,250

[22] Filed: Aug. 9, 1989

[30] Foreign Application Priority Data

Aug. 10, 1988 [JP] Japan ..... 63-199588

[51] Int. Cl.[5] ..... G03G 15/00

[52] U.S. Cl. ..... 355/218; 355/313; 355/326

[58] Field of Search ..... 355/313, 218, 210, 326, 355/327, 245, 328; 358/300; 346/157, 160; 118/645, 653

[56] References Cited

U.S. PATENT DOCUMENTS

| | | | |
|---|---|---|---|
| 3,914,043 | 10/1975 | McVeigh . | |
| 4,627,707 | 12/1986 | Tani et al. . | |
| 4,742,373 | 5/1988 | Nakatani | 355/218 X |
| 4,814,824 | 3/1989 | Ito et al. . | |
| 4,839,696 | 6/1989 | Ohtani | 355/218 |
| 4,847,654 | 7/1989 | Honma et al. | 355/243 X |
| 4,862,216 | 8/1989 | Higashi et al. . | |
| 4,862,219 | 8/1989 | Yoshida et al. | 355/218 X |
| 4,866,486 | 9/1989 | Higashio et al. | 355/326 |
| 4,924,264 | 5/1990 | Ito et al. | 355/204 |
| 5,006,890 | 4/1991 | Ishida et al. | 355/202 |

FOREIGN PATENT DOCUMENTS 61-203474 9/1986 Japan .

*Primary Examiner*—A. T. Grimley
*Assistant Examiner*—T. A. Dang
*Attorney, Agent, or Firm*—Burns, Doane, Swecker & Mathis

[57] ABSTRACT

A copying machine which includes a document support for supporting a document to be copied; an image forming device having first, second and third image forming modes for forming an image of the document on the document support on a copying sheet; an area specifying unit for specifying at least first and second areas of the document and for dividing the document into first and second areas and an area other than the first and second areas; an automatic specifying unit operable in response to a specification by the area specifying unit to specify one of the first, second and third image forming modes automatically according to predetermined rules relative to the first, second and third areas of the document, respectively; a manual specifying unit for manually changing one of the image forming modes which has been specified by the automatic specifying unit; and a control unit for controlling the image forming device by which images corresponding to the first, second and third areas can be formed under the image forming mode specified by either the automatic specifying unit or the manual specifying unit.

5 Claims, 12 Drawing Sheets

DEVICE AND METHOD FOR FORMING AN IMAGE OF A DOCUMENT IN MORE THAN ONE COLOR INCLUDING AUTOMATIC OR USER SELECTION OF COLORS TO BE USED IN SPECIFIED AREAS OF THE DOCUMENT

BACKGROUND OF THE INVENTION

1. Field of the Invention

The present invention relates to an image forming apparatus of a type having an image editing function and, also, a multi-color image copying function, and also to an image forming method practiced by the image forming apparatus of the type referred to above.

2. Description of the Prior Art

Various types of copying machines are currently utilized for making copies. Some of them have an image editing function, some have a multi-color developing function and some others have both of these functions.

With the copying machines of a type having the image editing function, an original image of a document is divided into a plurality of edited areas; some of the edited areas are copied and the others of the edited areas are not copied, that is, erased.

In the copying machines of a type having the multi-color image copying function, the machines are equipped with a plurality of developing units accommodating masses of toner material of different colors, which developing units can be selectively brought into operation for developing an electrostatic latent image with the toner material.

With the copying machines of a type having both of the image editing function and the multi-color copying function, it is possible to develop images of the divided areas of the document in different colors. The present invention pertains to this type of copying machine and, therefore, reference will be made thereto in the following description.

According to the copying machine having both of the image editing function and the multi-color copying function, specification of the color in which some areas of the document are to be copied is carried out for each of the divided areas of the document. Considering the copy making jobs for specifying the colors in which the areas of the document are to be copied, one will realize that a particular one of the colors is dominantly selected and a greater number of copies are made in that particular color.

By way of example, assuming that the document to be copied is divided into three, first, second and third areas, the most common type of copy making job is to copy the first area in a black color, to copy the second area in a red color and to copy the third area in the form as erased with no image consequently formed. Accordingly, once the number of areas into which the document is divided and the types of color which an operator of the copying machine can specify are given, it is possible to design the machine so that the specification of a particular one of the colors (including an erasure) can be automated to some extent, which machine appears to please potential users of the copying machine.

SUMMARY OF THE INVENTION

In view of the foregoing, the present invention is intended to provide an improved image forming apparatus of a type having both of the image editing and multi-mode copying functions, wherein the specification of a particular one of the modes in which areas of a document is copied can be automatically carried out.

According to the present invention, there is provided a copying machine which comprises a document support for the support thereon of a document to be copied; an image forming means having first, second and third image forming modes for forming an image of the document on the document support on a copying sheet; an area specifying means for specifying at least first and second areas of the document and for dividing the document into first and second areas and an area other than the first and second areas; an automatic specifying means operable in response to a specification by the area specifying means to specify one of the first, second and third image forming modes automatically according to predetermined rules relative to the first, second and third areas of the document, respectively; a manual specifying means for manually changing one of the image forming modes which has been specified by the automatic specifying means; and a control unit for controlling the image forming means whereby images corresponding to the first, second and third areas can be formed under the image forming mode specified by either the automatic specifying means or the manual specifying means.

With this system, the image forming modes such as the modes for the developing colors and erasure can be automatically determined for each of the areas of the document so divided arbitrarily and the image forming operation can take place under the mode so determined. Moreover, the mode so determined is the one which is frequently utilized. Accordingly, a laborious procedure for specifying the developing color for each area can be eliminated.

BRIEF DESCRIPTION OF THE DRAWINGS

This and other objects and features of the present invention will become clear from the following description taken in conjunction with a preferred embodiment thereof with reference to the accompanying drawings, in which.

DETAILED DESCRIPTION OF THE EMBODIMENT

Figure 1:
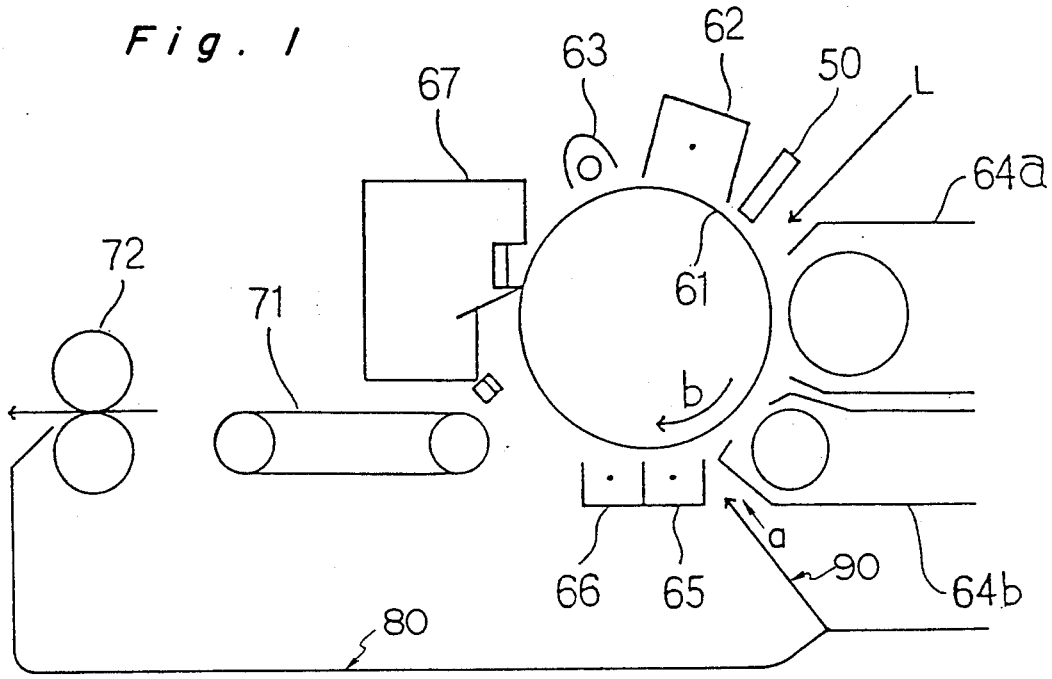
FIG. 1 is a schematic diagram showing a copying machine embodying the present invention.

FIG. 1 is a schematic diagram illustrating an image forming mechanism that is employed in an electrophotographic copying machine embodying the present invention. Referring to FIG. 1, the image forming mechanism comprises a photoreceptor drum 61 supported within a machine housing for rotation in one direction shown by the arrow b past a plurality of processing stations that are defined in the vicinity of an outer periphery of the photoreceptor drum 61. In the vicinity of and around the photoreceptor drum 61, an eraser lamp 63, an electrostatic charger 62, an interimage eraser 50, a first developing unit 64*a* accommodating therein a mass of black toner material therein, a second developing unit 64*b* accommodating therein a mass of colored toner material, a transfer charger 65, a separating charger 66 and a cleaning unit 67 are disposed in this order specified.

At a left-hand portion of the image forming mechanism of the copying machine as viewed in FIG. 1, a fixing unit 72 for permanently fixing a visible powder image, which has been transferred from the photoreceptor drum 61 onto a copying sheet, and a generally endless belt 71 for the transportation of the copying sheet towards the fixing unit 72 are disposed. For receiving the visible powder image from the photoreceptor drum 61 at a transfer station, the copying sheet referred to above can be supplied at a predetermined timing towards the transfer station along a passage 90 in a direction shown by the arrow a and from a right-hand direction as viewed in FIG. 1.

Hereinafter, the sequence of the image forming process will be described. As is well known to those skilled in the art, during one complete rotation of the photoreceptor drum 61 in the direction a, a residue charge remaining on a photosensitive surface of the photoreceptor drum 61 that is formed during the previous cycle of copying operation is removed by radiation from the eraser lamp 63 and, thereafter, the photosensitive surface of the photoreceptor drum 61 is uniformly charged by the charger 62. Areas desired to be erased are subsequently radiated by the interimage eraser 50 for the removal of the charge in those areas. It is to be noted that each area desired to be erased is intended to mean, for example, that area of an original which is not desired to be copied, and can be defined as an erase area during an edited copying mode of the machine.

The interimage eraser 50 is employed in the form of a plurality of light emitting elements lined up in a line direction parallel to the axis of rotation of the photoreceptor drum 61, which axis of rotation lies perpendicular to the drawing of FIG. 1. Although not shown, a drive control circuit for controlling the interimage eraser 50 is so designed that the individual light emitting elements can be selectively switched on and off.

A selective radiation performed by the interimage eraser 50 to dissipate a partial charge on one or more erase areas can be accomplished by controlling ON and OFF states of some of the light emitting elements of the interimage eraser 50 as far as the line direction is concerned, and by controlling the timing at which the light emitting elements are selectively switched on and off as far as the direction in which the image is advanced (that is, the circumferential direction of the photoreceptor drum 61).

During the continued rotation of the photoreceptor drum 61, and subsequent to the erasure of the partial charge on the photosensitive surface performed by the interimage eraser 50, the photosensitive surface of the photoreceptor drum 60 is exposed to imagewise rays of light L reflected from a document on a document support and, accordingly, carrying an image of the document. As a result thereof, portion of the electrostatic charge on the photosensitive surface is dissipated leaving an electrostatic latent image corresponding to the image of the original, which electrostatic latent image is represented by a pattern of distribution of electrostatic charge corresponding to the amount of the imagewise rays of light. It is, however, to be noted that no electrostatic charge is built up in the erase area, that is, the area of the photosensitive surface radiated by the interimage eraser 50.

The electrostatic latent image so formed is subsequently developed into a visible powder image by one of the first and second developing units 64*a* and 64*b*. In the illustrated copying machine, the first developing unit accommodates therein a mass of black toner material whereas the second developing unit accommodates therein a mass of red toner material. Accordingly, in the subsequent description made in connection with the flowchart, where "Color" is specified and set as a specified color for a certain edited area (area 1, or area 2, or the other area or areas), the development of a portion of the electrostatic latent image corresponding to such certain edited area is executed by the second developing unit 64*b* and, hence, a red-colored visible powder image can be formed on the photosensitive surface of the photoreceptor drum 61.

The visible powder image so formed on the photosensitive surface is subsequently transported towards a transfer station and is then electrostatically attracted onto a copying sheet by the action of the transfer charger 65, which copying sheet has been supplied into a gap between the transfer charger 65 and the photoreceptor drum 61 from the passage at a controlled timing, that is, in synchronism with the arrival of the visible powder image on the photoreceptor drum 61 at the transfer station.

The copying sheet onto which the visible powder image has been transferred is subsequently separated from the photosensitive surface by the action of the separating charger 66 and is then transported through the endless belt 71 towards the fixing unit 72 at which the visible powder image is permanently fixed on the copying sheet in a manner well known to those skilled in the art.

The copying sheet having the powder image permanently fixed thereon is ejected to the outside of the machine housing if a required copying job is completely finished.

On the other hand, if the required copying job has not yet been finished, the copying sheet having the powder image permanently fixed thereon is conveyed onto an intermediate sheet supply unit 80 and is subsequently supplied towards the image forming mechanism for making a composite or synthesized copy.

During the further continued rotation of the photoreceptor drum 61, and subsequent to the transfer of the visible powder image onto the copying sheet, the photosensitive surface of the photoreceptor drum 61 is cleaned by the cleaning unit 67 for the removal of a residue toner material remaining thereon, in readiness for the next cycle of copying operation.

Figure 2:
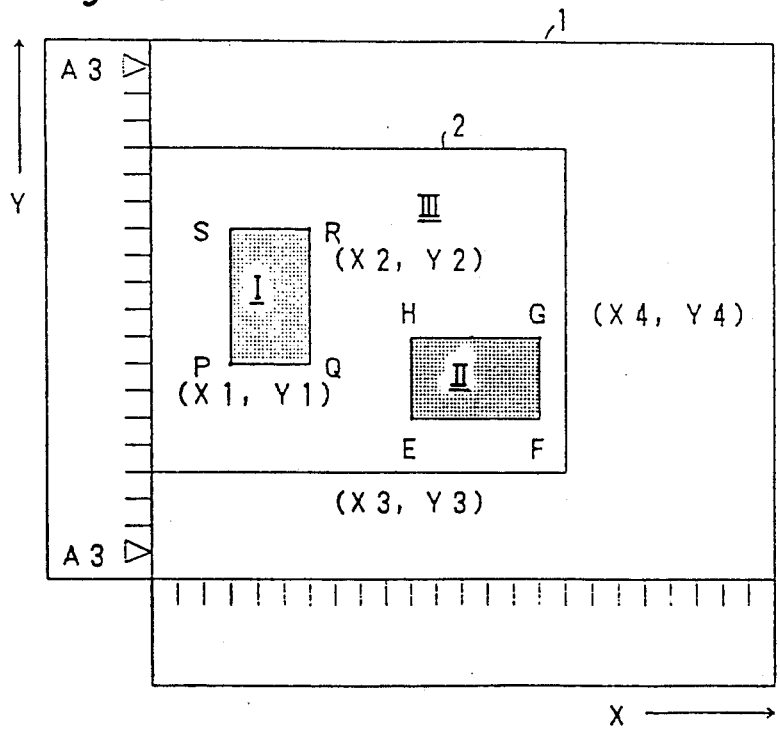
FIG. 2 is a schematic diagram used to explain how areas of a document to be edited are specified.

FIG. 2 illustrates the document support having the document 2 to be copied placed thereon, which support is generally identified by 1 and is in the form of a generally rectangular transparent plate glass. FIG. 2 is utilized to explain how the image of the document is divided into a plurality of edited areas and how a developing color, that is, the color in which a copy is to be made, is specified in coordination with each specified area.

Referring now to FIG. 2, the document 2 is shown as placed on the document support 1 with one edge thereof held in abutment with a document scale that is disposed on a left-hand end of the document support 1. For the purpose of the description of the preferred embodiment of the present invention, it is assumed that an operator of the copying machine wishes to make a copy in which an area I is developed in black, an area II is developed in red and an area III is erased. In order to accomplish this, coordinates that specify each of these areas must be defined and the developing color for each of these areas must also be specified.

The area I can be defined by specifying two points in coordinate system which are represented by P(X1, Y1) and R(X2, Y2), respectively.

The area II-can be defined by specifying two points in the same coordinate system which are represented by E(X3, Y3) and G(X4, Y4).

The area III which is the remaining area can be defined as a leftover area once the areas I and II have been defined.

Accordingly, in order to divide the document image into these three areas and then to specify the developing color in which each of the areas is to be developed, the four points in coordinate system which define two of the area have to be specified and inputted and, at the same time, the developing color has to be specified in association with each of these areas.

According to the present invention, as will be described later, the developing color to be assigned to each of the areas can be automatically specified temporarily.

Figure 3:
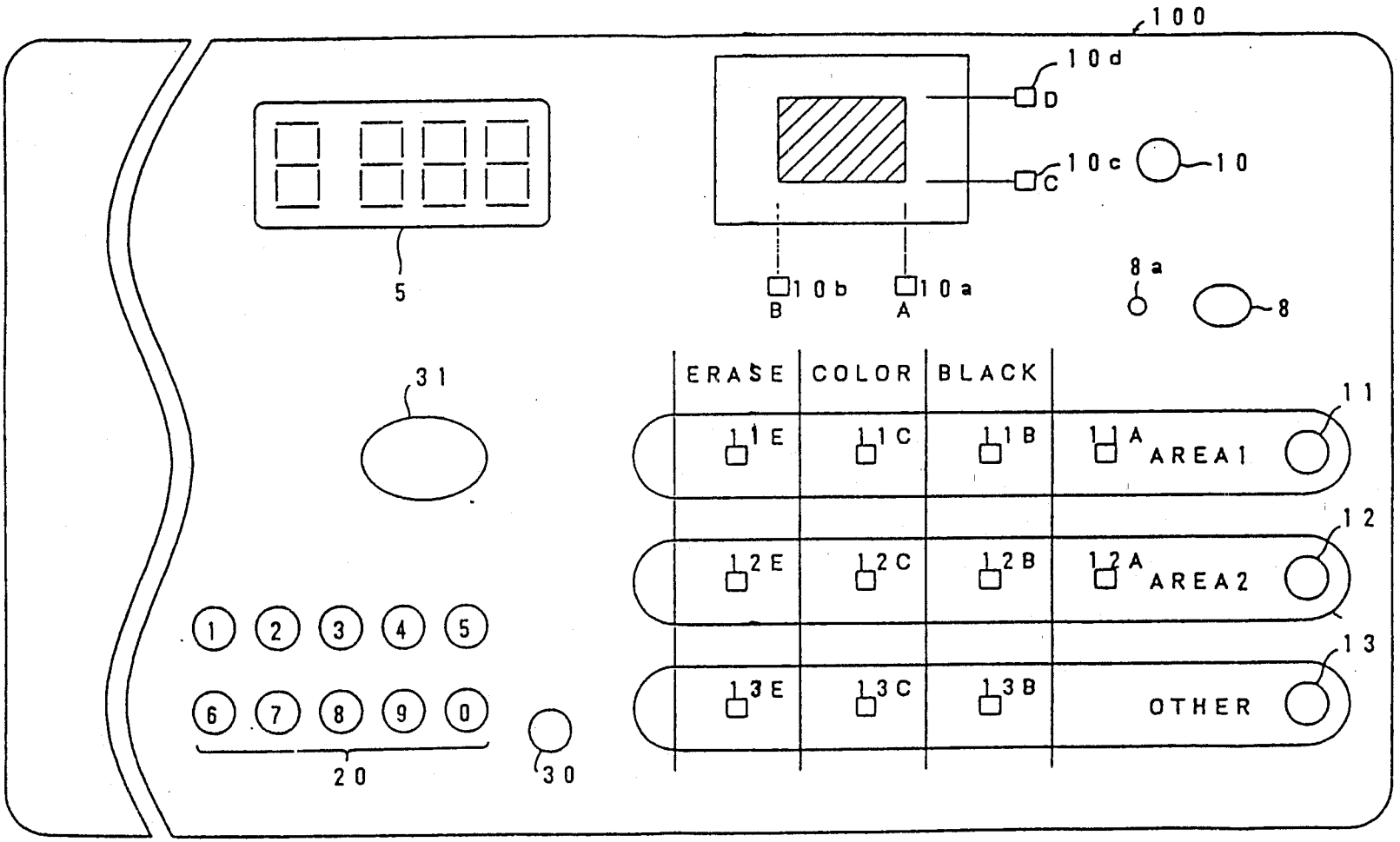
FIG. 3 is a schematic diagram showing a principal portion of a control panel on a machine housing of the copying machine.

FIG. 3 illustrates a principal portion of a control panel 100 disposed atop the machine housing. The control panel 100 shown therein includes a print key 31; a group of ten numerical input keys 20 for inputting numerical data; an editing mode key 8 for setting or cancelling an editing mode; an editing mode display light emitting diode (LED) 8*a* for providing a visual indication that the machine is set in the editing mode; a numerical value display unit 5 for displaying one of the number of copies to be made, the copying magnification and the edited coordinate data; coordinate display light emitting diodes (LED) 10*a* to 10*d* for guiding what inputted data are associated with which one of coordinate points A to D; a coordinate key 10 for registering the inputted numerical data in correspondence with the coordinate points A to D; an area I key 11 for specifying a coordinate input stand-by condition for the area 1 and also for sequentially changing the developing color for the area 1; an area 2 key 12 for specifying a coordinate input stand-by condition for the area 2 and also for sequentially changing the developing color for the area 2; an other area key 13 for sequentially changing the developing color for the remaining area; an area 1 display light emitting diode 11A for displaying a selected condition of the area 1; an area 2 display light emitting diode 12A for displaying a selected condition of the area 2; an area 1 black display light emitting diode 11B for displaying that "Black" is chosen as the specified color for the area 1; an area 1 color display light emitting diode 11C for displaying that "Color" is chosen as the specified color for the area 1; an area 1 erase display light emitting diode 11E for displaying that "Erasure" is chosen as the specified color for the area 1; an area 2 black display light emitting diode 12*b* for displaying that "Black" is chosen as the specified color for the area 2; an area 2 color display light emitting diode 12C for displaying that "Color" is chosen as the specified color for the area 2; an area 2 erase display light emitting diode 12E for displaying that "Erasure" is chosen as the specified color for the area 2; an other area black display light emitting diode 13B for displaying that "Black" is chosen as the specified color for the remaining area; an other area color display light emitting diode 13C for displaying that "Color" is chosen as the specified color for the remaining area; an other area erase display light emitting diode 13E for displaying that "Erasure" is chosen as the specified color for the remaining area; a clear key 30 for cancelling a key input; and so on.

Figure 4:
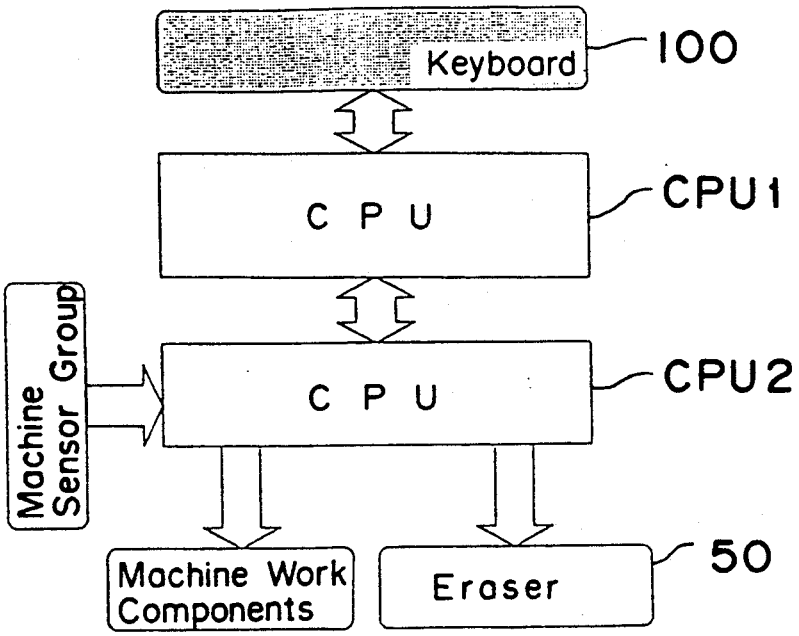
FIG. 4 is a circuit block diagram showing a control circuit used in the copying machine embodying the present invention.

A control circuit used to control the sequence of operation of the copying machine embodying the present invention is shown in FIG. 4 in block circuit representation. The control circuit comprises first and second central processing units CPU1 and CPU2 as its principal components.

As shown in FIG. 4, the central processing unit CPU1 is adapted to process inputs keyed in from the control panel 100 and also to control the drive of various display elements disposed on the control panel 100. On the other hand, the central processing unit CPU2 is adapted to control various operations of the copying machine such as a document scanning operation, an image forming operation, a sheet feeding operation and so on. The central processing units CPU1 and CPU2 are connected together by means of a bus so as to communicate with each other for controlling the operation of the copying machine.

By way of example, as will be described later, when the central processing unit CPU1 determines, in response to the keyed-in input, that "Color" has been chosen as the specified color for the area 1 and causes the area 1 color display light emitting diode 11C to be lit, the central processing unit CPU2 selects the second developing unit 64*b* into operation during the development of the area 1 so that the area 1 can be developed with red toner material. Also, when the central processing unit CPU1 determines, in response to the keyed-in input, that "Erasure" has been chosen as the specified color for the area 1 and causes the area 1 erase display light emitting diode 11E to be lit, the central processing unit CPU2 drives the interimage eraser 50 to selectively remove an electrostatic charge on an area corresponding to the area 1.

Hereinafter, the sequence of operation of the copying machine embodying the present invention will be described with reference to the flowchart shown in FIGS. 5 to 7.

Figure 5:
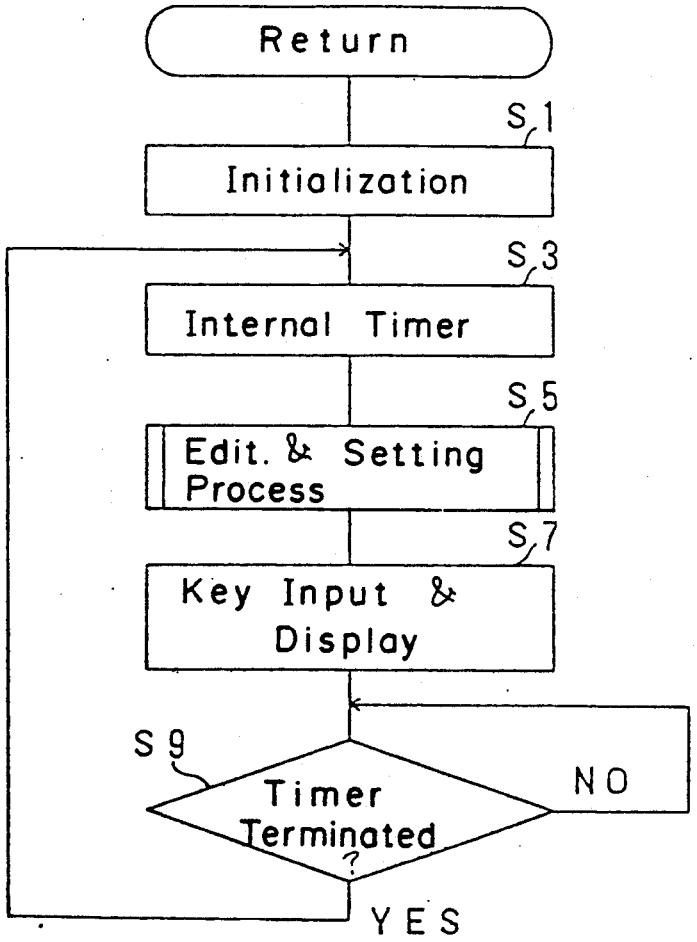
FIG. 5 is a flowchart showing a main routine executed by a central processing unit in the control circuit for controlling the sequence of operation of the copying machine embodying the present invention.

The main routine executed by the central processing unit CPU1 shown in FIG. 4 is illustrated in FIG. 5. It is, however, to be noted that the routine executed by the central processing unit CPU2 for controlling the sequence of operation of the copying machine itself is well known in the art and, therefore, the details thereof will not be herein reiterated for the sake of brevity.

Referring now to FIG. 5, the central processing unit CPU1, when powered on, starts its operation and, at step S1, initialization is carried out. At subsequent step S3, an internal timer for regulating a process time for one routine is started and, at step S5, a subroutine for an editing and setting process is called for, followed by step S7 at which processing of keyed-in inputs and displaying are performed.

Subsequent to step S7, a decision is made to determine if a preset time set in the internal timer has passed. If it has not yet been passed, the central processing unit CPU1 waits until the preset time in the internal timers is passed, but if the preset time has been passed, the program flow returns to step S3.

It is to be noted that the process performed at step S7 includes well-known processes such as, for example, a process subjected to the keyed-in input associated with the setting of a copying magnification, a process subjected to an input from the clear key 30, a process for displaying the number of copies desired to be made and other processes which have not direct concern with the subject matter of the present invention and which are, therefore, not described herein for the sake of brevity.

The details of the subroutine for the editing and setting process executed at step S5 of the main routine of FIG. 5 are shown in FIG. 6 comprised of FIGS. 6(A) to 6(I). During the execution of this subroutine, the execution of the processes is managed by an editing mode state counter ESC. During a process flow from step S101 to S113, a process related to an ON-edge of the editing mode key 8 is performed. The term "ON-edge" referred to above and hereinafter is intended to means the state of change of a signal from an OFF state to an ON state as a result of a key inputting.

Figure 6A:
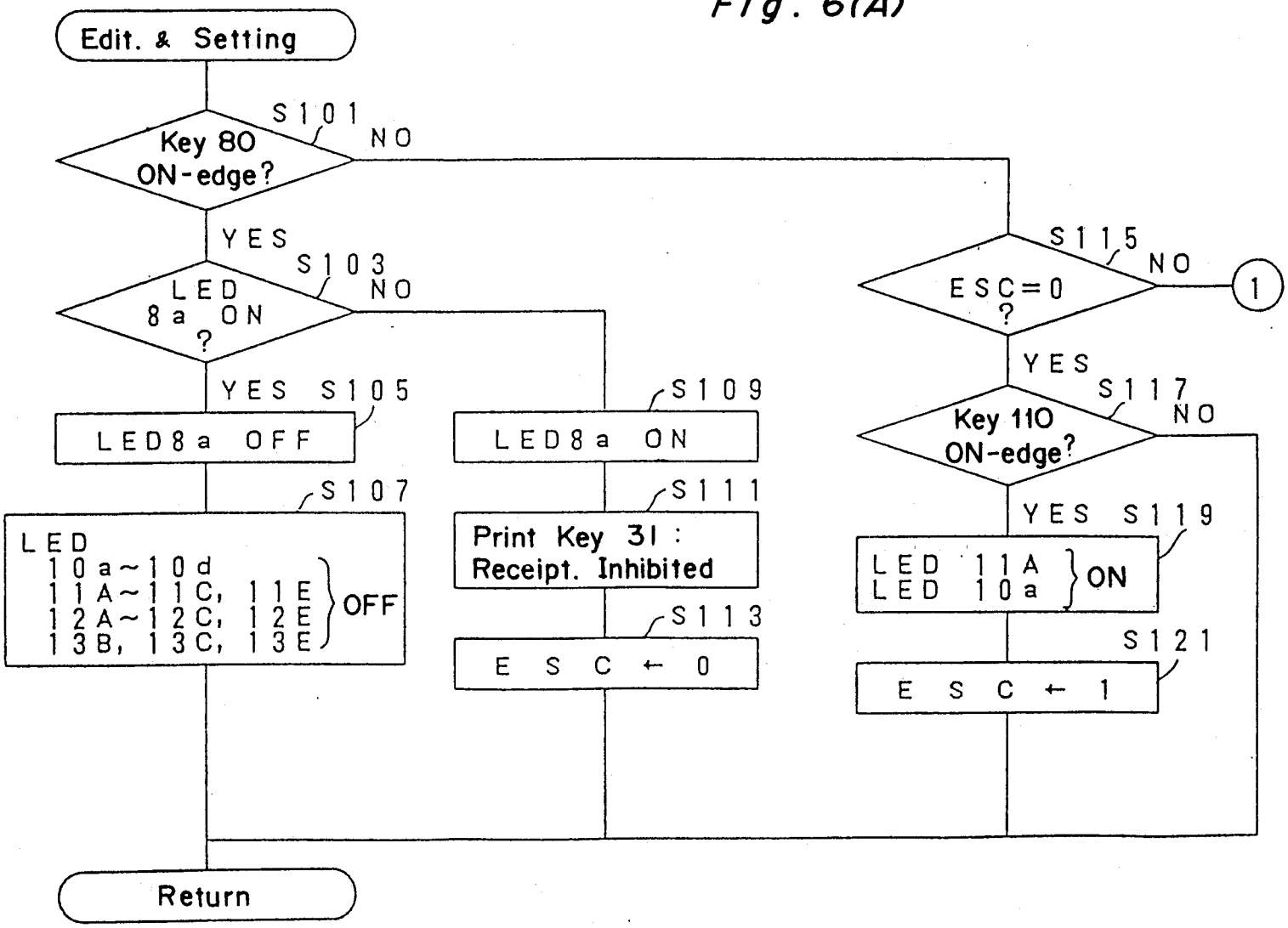
FIGS. 6(A), 6(B), 6(C), 6(D), 6(E), 6(F), 6(G), 6(H) and 6(I) illustrate respective portions of a flowchart of an editing process performed by the copying machine embodying the present invention.

Referring to FIG. 6(A), when the ON-edge of the editing mode key 8 is detected as indicated by "YES" at step S101, and if the editing mode display 8*a* is in an ON state as indicated by "YES" at step S103, the editing mode is cancelled and the editing mode display 8*a* is brought into an OFF state at step S105, followed by step S107 at which all of the coordinate displays 10*a* to 10*d*, the area 1 display 11A, the area 2 display 12A, and all of the color select displays 11B, 11C, 11E, 12B, 12C, 12E, 13B, 13C and 13E are brought into an OFF state.

Conversely, if the result of decision at step S103 indicates that the editing mode display 8*a* is in an OFF state, the editing mode is set up with the editing mode display 8*a* brought into an ON stat at step S109 and, at subsequent step S111, reception of an input signal from the print key 31 is inhibited, followed by step S113 at which the editing mode state counter ESC is zeroed.

After step S115, one of various branch flows is executed depending on the value of the editing mode state counter ESC. This process implements predetermined rules for specifying the image forming modes according to the present invention.

(1) When ESC=0

When the ON-edge of the area 1 key 11 is detected as indicated by "YES" at step S117 shown in FIG. 6(A), the area 1 display 11A for the display of a selected condition of the area 1 and the coordinate display 10*a* for the display of a stand-by condition in which an input of the A coordinate is waited for are brought into an ON state at step S119 and, at subsequent step S121, ESC is rendered to be 1.

(2) When ESC=1

Figure 6B:
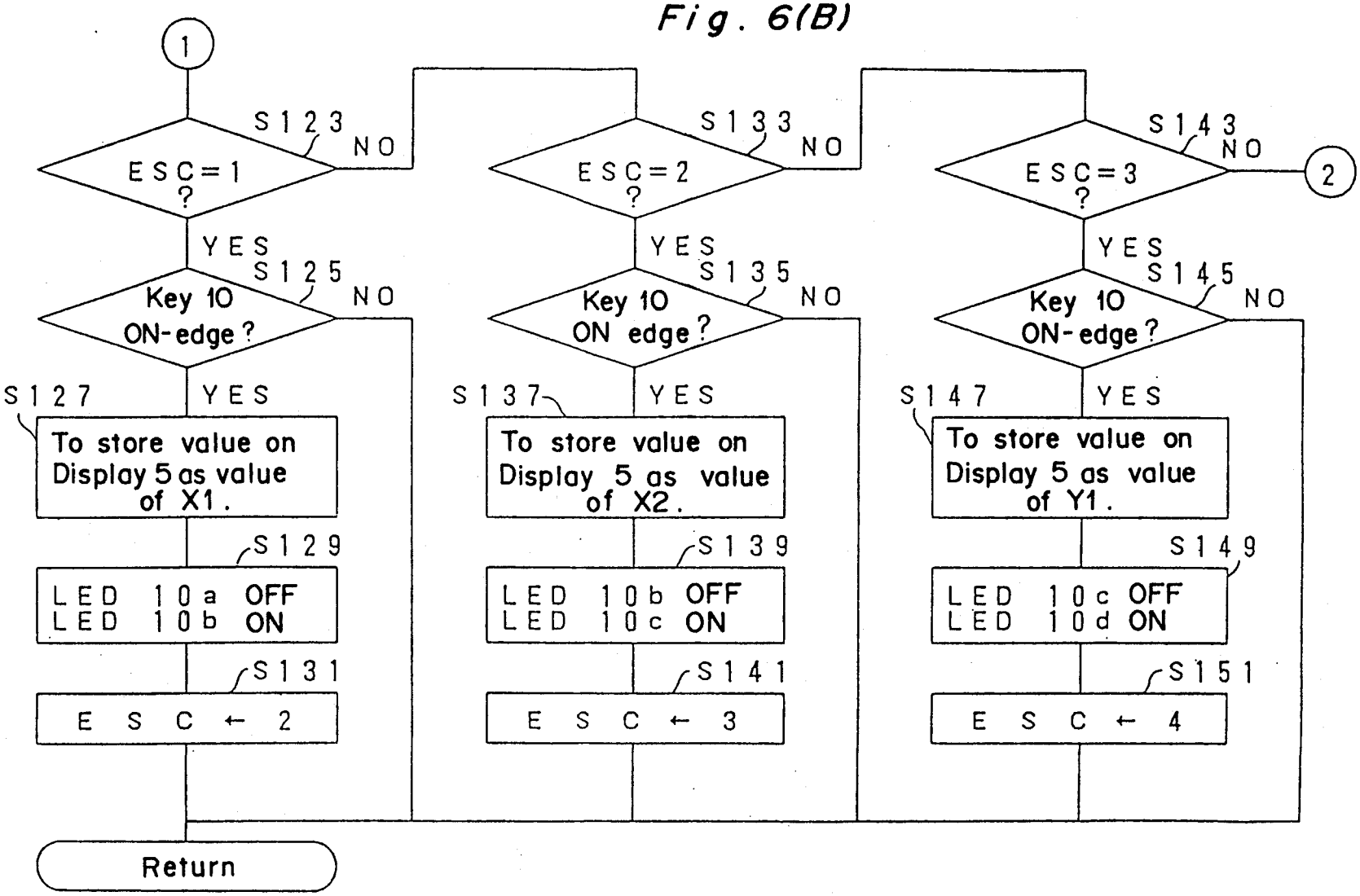

As shown in FIG. 6(B), when the ON-edge of the coordinate key 10 is detected as indicated by "YES" at step S125, the numerical value displayed at the display 5 is stored in X1 representing the A coordinate of the area 1 at step S127 and, at step S129, the A coordinate display 10*a* is brought into an OFF state while the B coordinate display 10*b* for the display of a stand-by condition in which an input of the B coordinate is waited for is brought into an ON state. Thereafter, step S131 takes place at which ESC is rendered to be 2.

(3) When ESC=2

As shown in FIG. 6(B), when the ON-edge of the coordinate key 10 is detected as indicated by "YES" at step S135, the numerical value displayed at the display 5 is stored in X2 representing the B coordinate of the area 1 at step S137 and, at step S139, the B coordinate display 10*b* is brought into an OFF state while the C coordinate display 10*c* for the display of a stand-by condition in which an input of the C coordinate is waited for is brought into an ON state. Thereafter, step S141 takes place at which ESC is rendered to be 3.

(4) ESC=3

As shown in FIG. 6(B), when the ON-edge of the coordinate key 10 is detected as indicated by "YES" at step S145, the numerical value displayed at the display 5 is stored in Y1 representing the C coordinate of the area 1 at step S147 and, at step S149, the C coordinate display 10*c* is brought into an OFF state while the D coordinate display 10*d* for the display of a stand-by condition in which an input of the D coordinate is waited for is brought into an ON state. Thereafter, step S151 takes place at which ESC is rendered to be 4.

(5) ESC=4

Figure 6C:
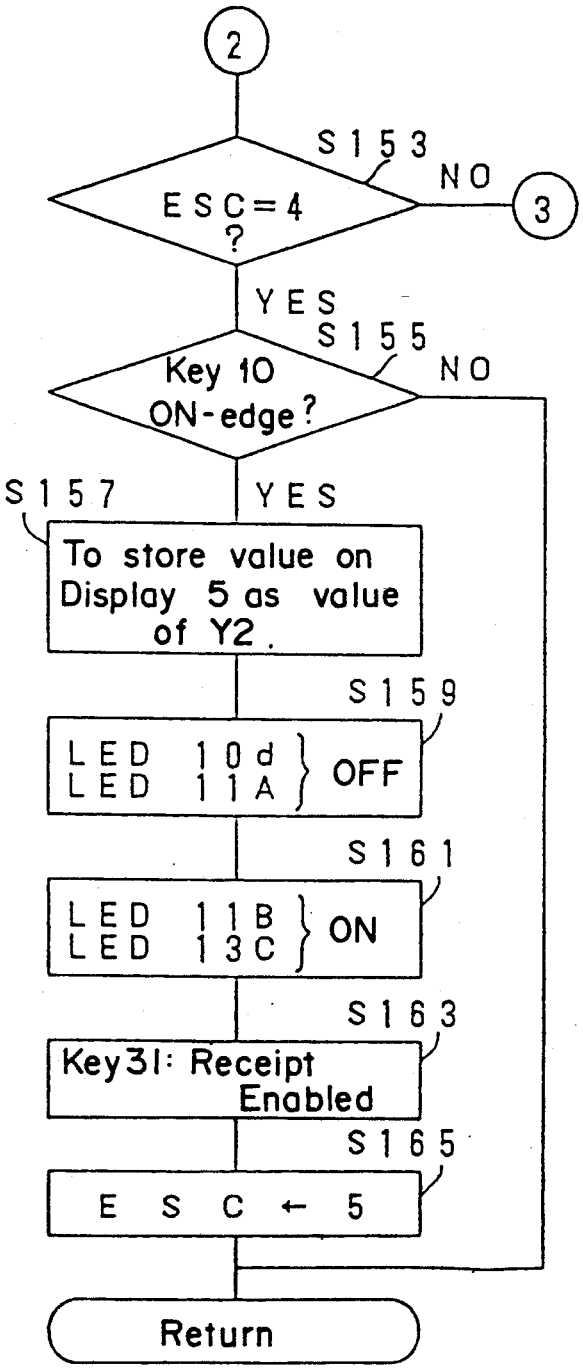

As shown in FIG. 6(C), when the ON-edge of the coordinate key 10 is detected as indicated by "YES" at step S155, the numerical value displayed at the display 5 is stored in Y2 representing the D coordinate of the area 1 at step S157 and, at step S159, both of the C coordinate display 10*d* and the area 1 display 11A for the display of the selected condition of the area 1 are brought into an OFF state. Then, "Black" and "Color" are selected for the developing color for the area 1 and the developing color for the other area, respectively, and the display light emitting diodes 11B and 13C for indicating these selected conditions, respectively, are brought into an ON state at step S161. At subsequent step S163, reception of the input from the print key 31 is enabled, followed by step S165 at which ESC is rendered to be 5.

In other words, the print operation is temporarily enabled while the area 1 and the other area and the developing colors therefor have been determined.

(6) When ESC=5

Figure 6D:
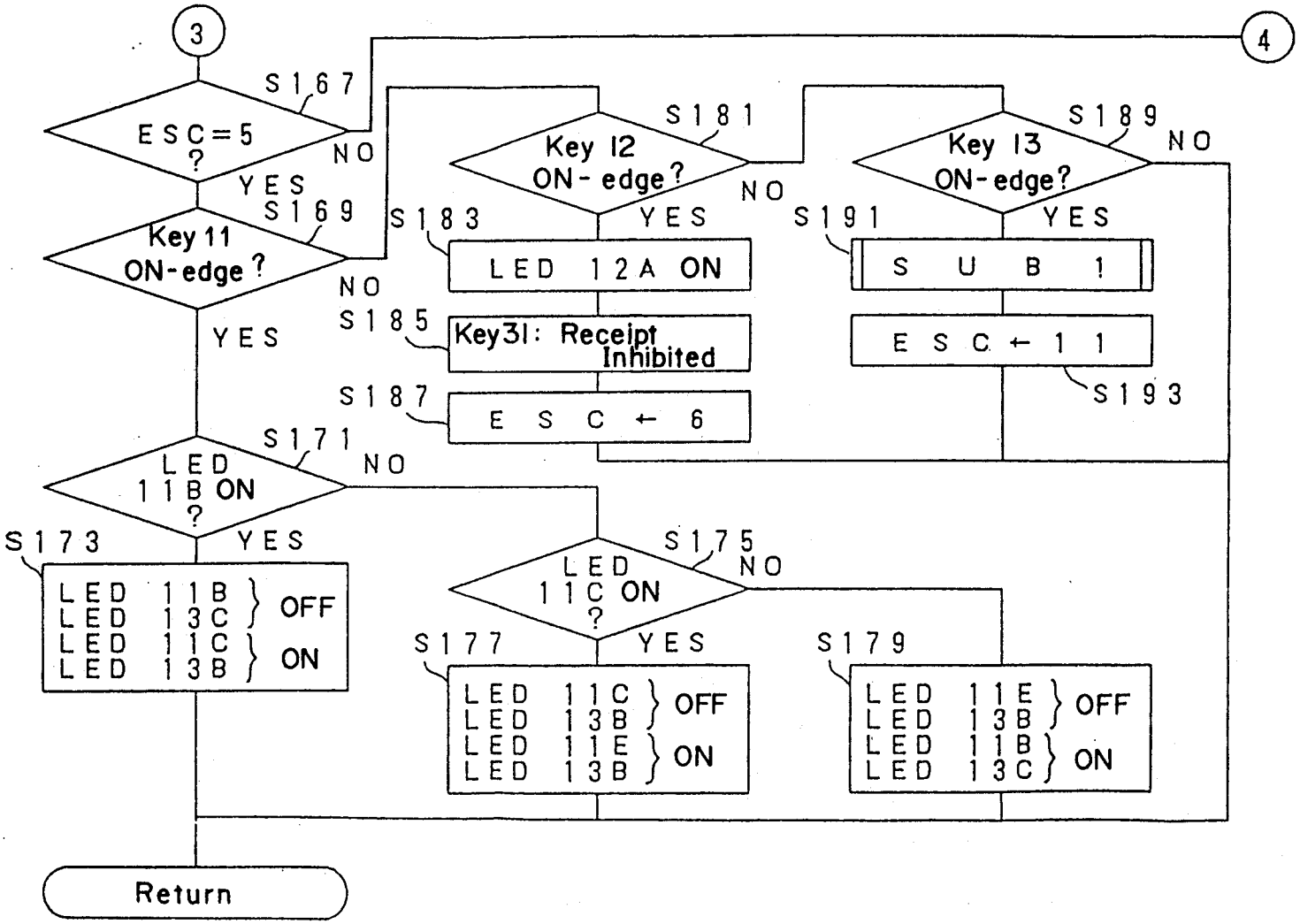

During the execution of the flow from step S169 to step S193 shown in FIG. 6(D), a process corresponding to the ON-edge of each of the area 1 key 11, the area 2 key 12 and the other area key 13 is performed.

In other words, when the ON-edge of the area 1 key is detected as indicated by "YES" at step S169 and if "Black" is selected as the developing color for the area 1 as indicated by "YES" at step S171 "Color" and "Black" are chosen as the developing colors for the area 1 and the other area, respectively, at step S173. Also, where "Color" is chosen as the developing color for the area 1 as indicated by "YES" at step S175, the area 1 is deemed as an area to be erased and "Black" is chosen as the developing color for the other area at step S177. On the other hand, if "Erasure" is chosen for the area 1, "Black" and "Color" are chosen as the developing colors for the area 1 and the other area, respectively, at step S179.

Where the ON-edge of the area 2 key is detected as indicated by "YES" at step S181, the area 2 display 12A for indicating the selected condition of the area 2 is brought into an ON state at step S182, reception of the input signal from the print key 31 is inhibited at step S185, and finally ESC is rendered to be 6 at step S187 to set a stand-by condition at which the input of the coordinates representative of the area 2 is waited for.

Figure 7:
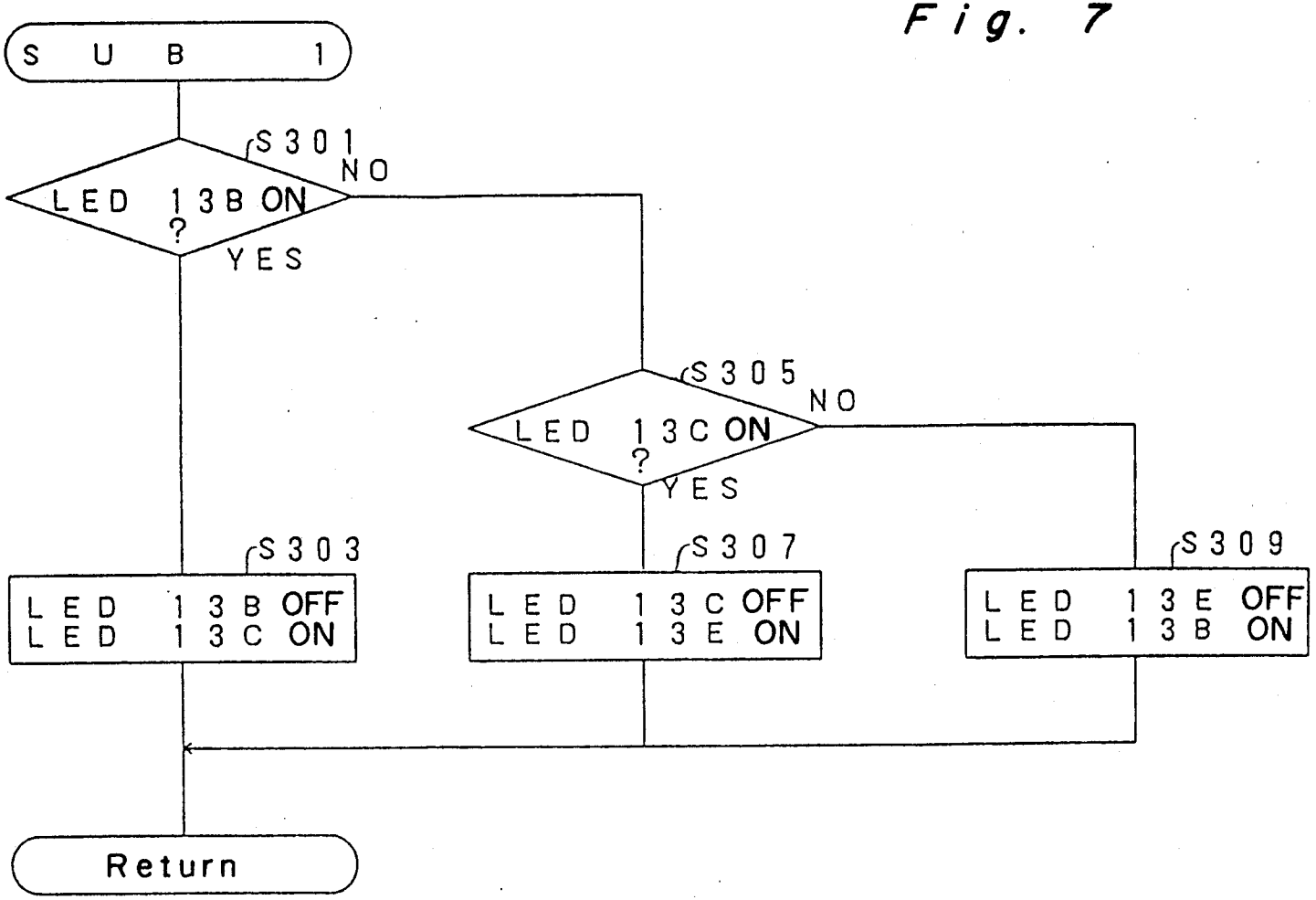
FIG. 7 is a flowchart showing a subroutine which is called for during the execution of the main routine shown in FIG. 6.

Also, where the ON-edge of the other area key 13 is detected as indicated by "YES" at step S189, a subroutine SUB1 shown in FIG. 7 is called for to set the developing color for the other area at step S191, followed by step S193 at which ESC is rendered to be 11.

It is to be noted that the subroutine SUB1 shown in FIG. 7 is a process for sequentially rotating and setting the developing color for the other area in correspondence with the ON-edge of the other area key 13. In other words, as shown in FIG. 7, if "Black" is chosen as the developing color for the other area, as indicated by "YES" at step S301, while the other area key 13 is in the ON-edge state, the developing color for the other area is chosen to be "Color" as indicated by "YES" at step S303, and if "Color" is chosen as indicated by "YES" at step S305, the other area is set as an area to be erased at step S307, but if "Erasure" is chosen, the developing color for the other area is chosen to be "Black" at step S309.

(7) ESC=6

Figure 6E:
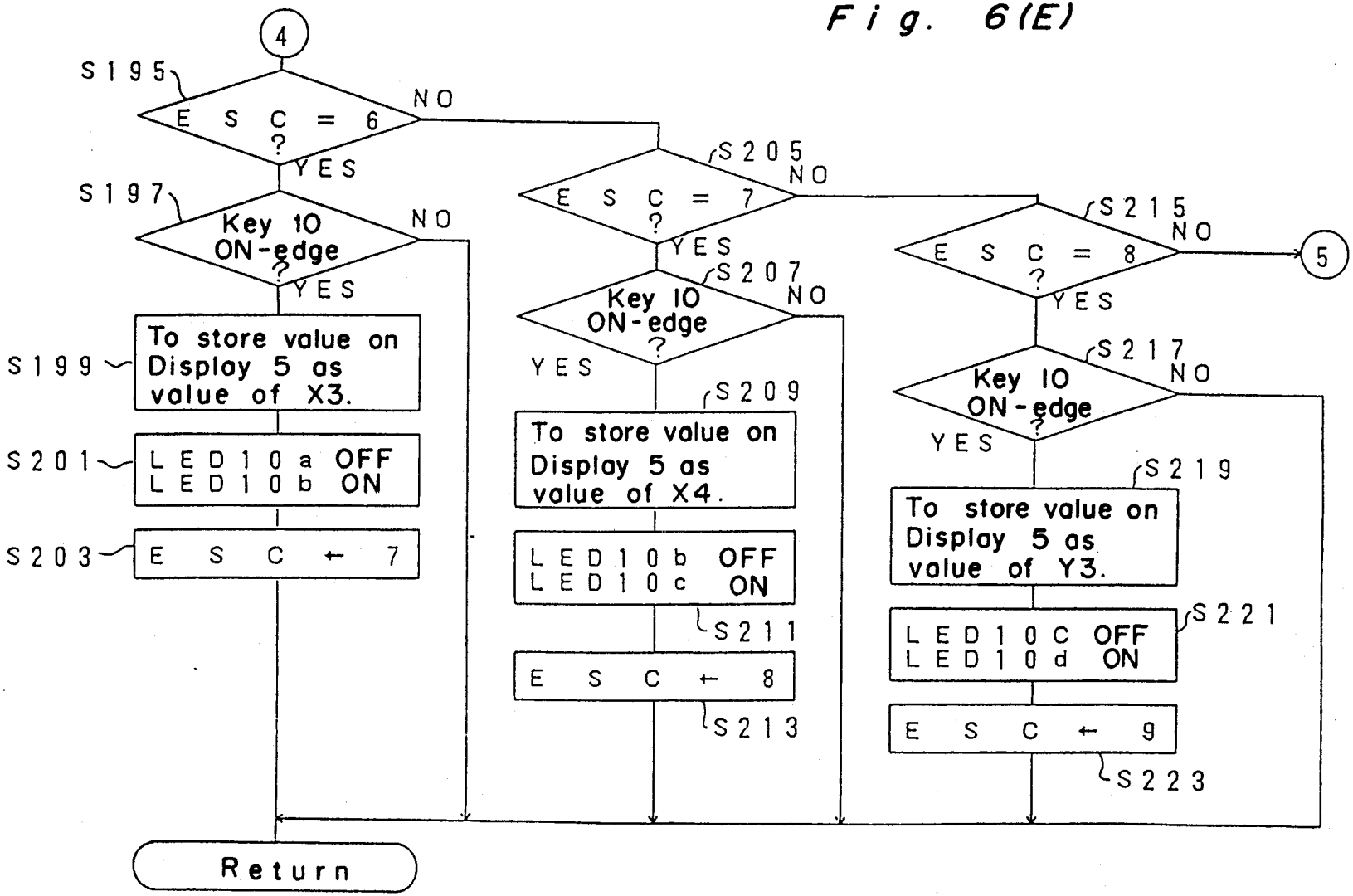

Referring to FIG. 6(E), when the ON-edge of the coordinate key 10 is detected as indicated by "YES" at step S197, the numerical value displayed at the display 5 is stored in X3 representing the A coordinate of the area 2 at step S199 and, at step S201, the A coordinate display 10*a* is brought into an OFF state while the B coordinate display 10*b* for the display of a stand-by condition in which an input of the B coordinate is waited for is brought into an ON state. Thereafter, step S203 takes place at which ESC is rendered to be 7.

(8) ESC=7

As shown in FIG. 6(E), when the ON-edge of the coordinate key 10 is detected as indicated by "YES" at step S207, the numerical value displayed at the display 5 is stored in X4 representing the B coordinate of the area 2 at step S209 and, at step S211, the B coordinate display 10*b* is brought into an OFF state while the C coordinate display 10*c* for the display of a stand-by condition in which an input of the C coordinate is waited for is brought into an ON state. Thereafter, step S213 takes place at which ESC is rendered to be 8.

(9) ESC=8

As shown in FIG. 6(E), when the ON-edge of the coordinate key 10 is detected as indicated by "YES" at step S217, the numerical value displayed at the display 5 is stored in Y3 representing the C coordinate of the area 2 at step S219 and, at step S221, the C coordinate display 10*c* is brought into an OFF state while the D coordinate display 10*d* for the display of a stand-by condition in which an input of the D coordinate is waited for is brought into an ON state. Thereafter, step S223 takes place at which ESC is rendered to be 9.

(10) ESC=9

Figure 6F:
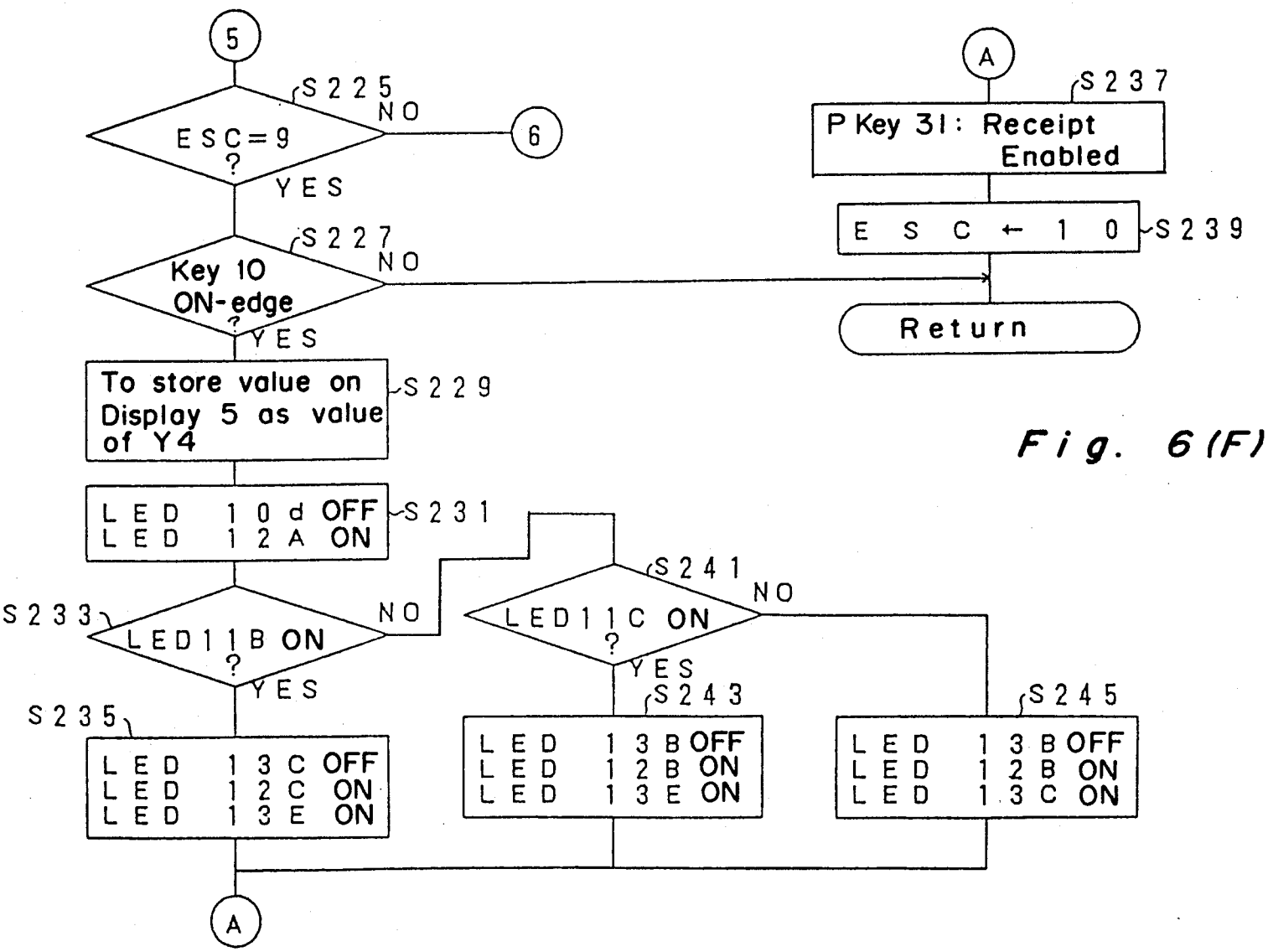

Referring to FIG. 6(F), when the ON-edge of the coordinate key 10 is detected as indicated by "YES" at step S227, the numerical value displayed at the display 5 is stored in Y4 representing the D coordinate of the area 2 at step S229 and, at step S231, both of the D coordinate display 10*d* and the area 2 display 12A for indicating the selected condition of the area 2 are brought into an OFF state. Also, where "Black" is set as the developing color for the area 1 as indicated by "YES" at step S233, "Color" and "Erasure" are chosen as the developing colors for the area 2 and the other area, respectively, at step S235. Again, where "Color" is set as the developing color for the area 1 as indicated by "YES" at step 241, "Black" and "Erasure" are chosen as the developing colors for the area 2 and the other area, respectively, at step S243. Yet, where "Erasure" is set for the area 1, "Black" and "Color" are chosen as the developing colors for the area 2 and the other area, respectively, at step S245. Then, reception of the input from the print key 31 is enabled at step S237, followed by step S239 at which ESC is rendered to be 10.

In other words, the print operation is temporarily enabled while the areas 1 and 2 and the other area and the developing colors therefor have been determined.

(11) ESC=10

Figure 6G:
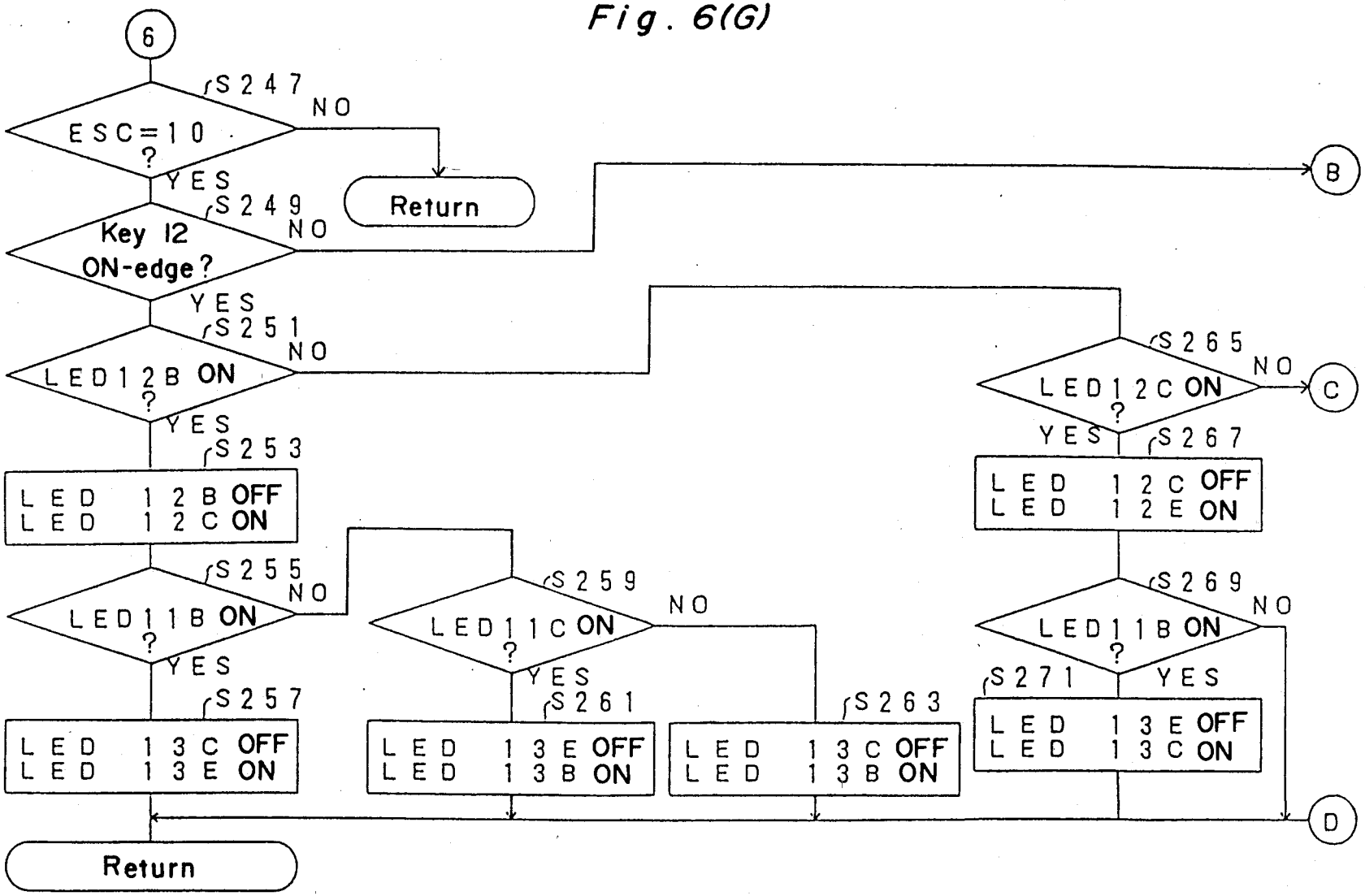
Figures 6H, 6I:
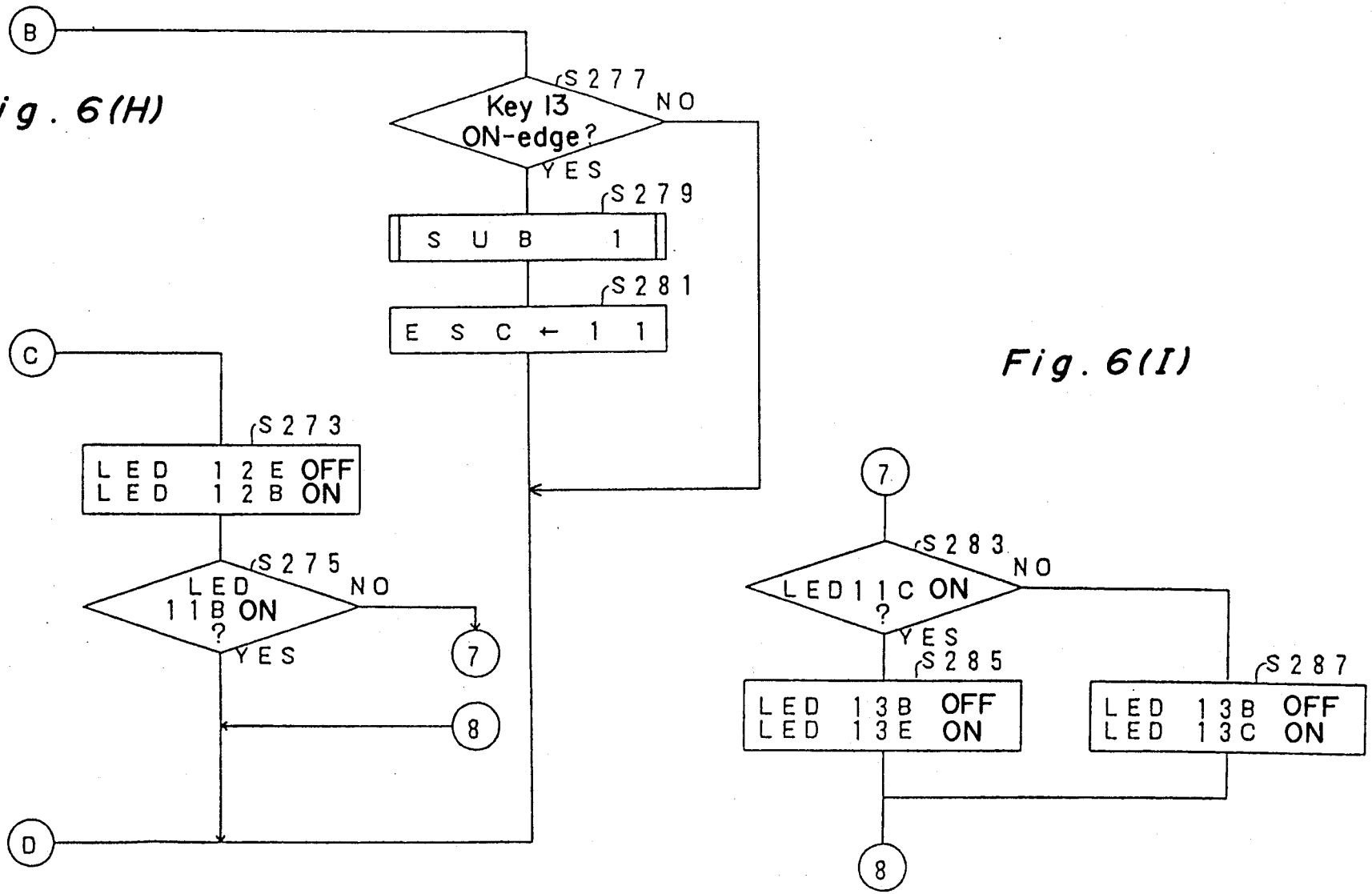

During the execution of the flow from step S251 to step S275 shown in FIGS. 6(G) and FIG. 6(H) and from step S283 to step S287 shown in FIG. 6(I), a process for setting the developing color for each of the areas is performed in correspondence with the ON-edge of the area 2 key 12.

In other words, when the ON-edge of the area 2 key 12 is detected as indicated by "YES" at step S249 and if "Black" is selected as the developing color for the area 2 as indicated by "YES" at step S251, "Color" is chosen as the developing colors for the area 2 at step S253. Also, where "Black" is at this time chosen as the developing color for the area 2 as indicated by "YES" at step S255, the other area is set as an area to be erased at step S257. On the other hand, if "Color" is chosen as the developing color for the area 1 as indicated by "YES" at step S259, "Black" is chosen as the developing color for the other area at step S263.

Where the ON-edge of the area 2 key 12 is detected as indicated by "YES" at step S249, and if "Color" is chosen as the developing color for the area 2 as indicated by "YES" at step S265, the area 2 is set as an area to be erased at step S267. If "Black" is at this time set as the developing color for the area 1 as indicated by "YES" at step S269, "Color" is chosen as the developing color for the other area at step S271.

Where the ON-edge of the area 2 key 12 is detected as indicated by "YES" at step S249 and if the area 2 is set as an area to be erased, "Black" is set as the developing color for the area 2 at step S273. Also, if at this time "Color" is set as the developing color for the area 1 as indicated by "YES" at step 283, the other area is set as an area to be erased at step S285. Again, if the area 1 is set as an area to be erased, "Color" is set as the developing color for the other area at step S287.

The flow from step S277 to step S281 shown in FIG. 6(H) is a process for setting the developing color for the other area in correspondence with the ON-edge of the other area key 13. In other words, when the ON-edge of the other area key 13 is detected as indicated by "YES" at step S277, the subroutine SUB1 shown in FIG. 7 is executed at step S279 to set the developing color for the other area in the manner as hereinbefore described. Thereafter, ESC is rendered to be 11. However, if the result of decision at step S247 shown in FIG. 6(G) indicates that ESC is not 10, the program flow returns.

As hereinbefore described, the process under the setting of the editing mode is executed to set the area and the developing colors.

Although the present invention has fully been described in connection with the preferred embodiment thereof with reference to the accompanying drawings, it is to be noted that various changes and modifications are apparent to those skilled in the art. Such changes and modifications are to be understood as included within the scope of the present invention as defined by the appended claims, unless they depart therefrom.

What is claimed is:

1. A method for forming an image of a document, placed on a document support, on a copying sheet with the use of a copying machine having a plurality of different image forming modes, which method comprises:

dividing the document into a desired number of areas;

automatically allocating, in response to a specification by an area specifying means, predetermined image forming modes according to first rules relative to the areas;

manually inputting a mode change command when the image forming modes automatically allocated according to the first rules are desired to be changed;

automatically allocating, in response to the mode change command, predetermined image forming modes according to second rules relative to the areas; and forming images, corresponding to the areas, under the image forming modes allocated to the areas.

2. A copying machine which comprises:

a document support for supporting thereon a document to be copied;

an image forming means for forming an image of the document on the document support on a copying sheet, said image forming means having a plurality of different image forming modes, wherein said image forming means comprises a first developing means for forming an image in a first color, a second developing means for forming an image in a second color and an erasing means for inhibiting an image forming operation at both of the first and second developing means, and has a first mode during which the first developing means is operated, a second mode during which the second developing means is operated and an erasing mode during which the erasing means is operated;

an area specifying means for dividing the document into a desired number of areas;

a first mode setting means operable in response to a specification by the area specifying means to allocate a predetermined image forming modes to the areas respectively according to a first rule;

an input means for manually inputting a mode change command;

a second mode setting means operable in response to the mode change command to re-setting the image forming modes relative to the areas according to a second rule which is different from the first rule; and a control means for controlling the image forming means so as to form images corresponding to the areas under the image forming modes allocated to the areas.

3. A copying machine which comprises:

a document support for supporting thereon a document to be copied;

an image forming means for forming an image of the document on the document support on a copying sheet, said image forming means having a plurality of image forming modes;

a copying initiating command input means for inputting a copying initiating command;

an area specifying means for specifying at least a first area and a second area of the document;

an input mode setting means for setting a first input mode during which specification of the first area by the specifying means is enabled and a second input mode during which specification of the second area by the specifying means is enabled;

a first inhibiting means operable in response to the setting of the first input mode to inhibit an input of the copying initiating command;

a first mode setting means operable during the first input mode to set one of the image forming modes relative to the first area specified by the area specifying means and also operable to cancel inhibition by the first inhibition means after the setting of said one of the image forming modes relative to the first area;

a second inhibiting means operable in response to the setting of a second setting mode to inhibit an input of the copying initiating command;

a second mode setting means operable during the second input mode to set one of the image forming modes relative to the second area specified by the area specifying means and also operable to cancel the inhibition by the second inhibiting means after the setting of said one the image forming modes relative to the second area;

a control means operable in response to the copying initiating command to control the image forming means so as to form images, corresponding to the first area specified and the second area specified, under the set image forming mode.

4. The machine as claimed in claim 3, wherein said image forming means comprises a first developing means for forming an image in a first color, a second developing means for forming an image in a second color and an erasing means for inhibiting an image forming operation of both of the first developing means and the second developing means, and has a first mode during which the first developing means is operated, a second mode during which the second developing means is operated and an erasing mode during which the erasing means is operated.

5. A method for forming an image of a document, placed on a document support, on a copying sheet with use of a copying machine having a first mode in which the image of original is formed in a first color, a second mode in which the image of original is formed in a second color and a third mode in which the image is erased, which method comprises:

dividing the document into a desired number of areas;

automatically allocating, in response to a specification by an area specifying means, predetermined ones of the first mode, second mode, or third mode according to first rules relative to the areas;

manually inputting a mode change command when the predetermined ones of the first mode, second mode, or third mode automatically allocated according to the first rules are desired to be changed;

automatically allocating, in response to the mode change command, predetermined ones of the first mode, second mode or third mode according to second rules relative to the areas; and forming images, corresponding to the areas, under the predetermined ones o the first mode, second mode or third mode allocated to the areas.

* * * * *